US007296349B2

(12) United States Patent
Gartner et al.

(10) Patent No.: US 7,296,349 B2
(45) Date of Patent: Nov. 20, 2007

(54) METHOD TO ASSEMBLE A STEAM GENERATOR

(75) Inventors: Rolf Gartner, Stuttgart (DE); Thomas Dressel, Bietigheim-Bissingen (DE)

(73) Assignees: ALSTOM Power Boiler GmbH, Stuttgart (DE); ALSTOM Power Boiler Service GmbH, Neumark (DE)

( * ) Notice: Subject to any disclaimer, the term of this patent is extended or adjusted under 35 U.S.C. 154(b) by 550 days.

(21) Appl. No.: 10/902,907

(22) Filed: Jul. 30, 2004

(65) Prior Publication Data

US 2005/0072000 A1 Apr. 7, 2005

(30) Foreign Application Priority Data

Jul. 31, 2003 (DE) ..... 103 35 499

(51) Int. Cl.
*B21D 51/24* (2006.01)
*F22B 37/36* (2006.01)

(52) U.S. Cl. ..... 29/890.051; 29/890.03; 29/429; 122/494

(58) Field of Classification Search ..... 29/890.03, 29/890.051, 428; 122/494, 510, 511; 52/745.2; 376/462; 248/68.1
See application file for complete search history.

(56) References Cited

U.S. PATENT DOCUMENTS 3,751,783 A 8/1973 Roberts, Jr. et al. ..... 29/157.4
6,588,104 B2 * 7/2003 Heidrich ..... 29/890.051

FOREIGN PATENT DOCUMENTS

| | | | |
|---|---|---|---|
| DE | 690 00 992 T2 | | 6/1993 |
| DE | 100 14 758 A1 | | 10/2001 |
| FR | EP 402248 A1 | * | 12/1990 |
| JP | 04257602 A | | 11/1992 |

OTHER PUBLICATIONS

German Search Report, dated Feb. 3, 2004.

* cited by examiner

*Primary Examiner*—David P. Bryant
*Assistant Examiner*—Sarang Afzali
(74) *Attorney, Agent, or Firm*—Alix, Yale & Ristas, LLP

(57) ABSTRACT

When constructing a steam generator, buckstay modules are joined with tube wall units to form buckstay and tube wall modules while the boiler steel structure is being erected, and they are temporarily placed within the boiler steel structure level by level. Then an external part of the boiler top main grid is constructed whose beams are flush with the tube walls of the buckstay and tube wall modules. Then the boiler wall is mounted by aligning and welding the individual tube wall modules from top to bottom. Simultaneously, the internal components are constructed on the boiler base and hoisted to installation height. Preassembling buckstay and tube wall modules eliminate the need for inserting buckstays or tube walls from above through the boiler top main grid. For this reason, the roof opening can be smaller than usual. The inner boiler top main grid therefore does not require its own main beams, which saves a substantial amount of steel.

9 Claims, 9 Drawing Sheets

METHOD TO ASSEMBLE A STEAM GENERATOR

BACKGROUND OF THE INVENTION

The invention relates to a method to assemble a steam generator, whose tube walls form a gas pass and that are suspended in a boiler steel structure, as well as such a steam generator.

Large steam generators are large structures containing a substantial amount of material, and various methods have been suggested and are used to assemble them. For example, JP 04257602 A proposes an assembly method for steam generators in which crossbeams are provided in the boiler steel structure that extend outward so that hoistable platforms can be suspended on them to improve the efficiency and safety of assembling tube walls. Furthermore, the cited document discloses the simultaneous assembly of buckstays, internal components, and tube walls for different height zones and hoisting them into installation position as soon as the module is completed.

In addition, an assembly method is known from DE 690 00 992 T2 for a steam generator in which the boiler steel structure and an outer part of the boiler top main grid is erected first. Then the main beams are assembled on the boiler base as well as additional beams for the subsequent boiler top main grid that form a grid. The main beams of this grid then lie inside the subsequent boiler. The boiler top main grid formed in this manner is successively hoisted, and the boiler including the internal components, tube wall and buckstays are gradually lifted.

In this assembly method, boiler assembly can only begin after the boiler steel structure is already in place.

In U.S. Pat. No. 3,751,783, another steam generator is disclosed that is constructed as a tube wall boiler. The outer boiler steel structure bears internal components that are constructed on the boiler base after the boiler wall is erected, and then gradually hoisted and mounted there.

In this assembly procedure, the internal components can be assembled only after the boiler steel structure and boiler wall are finished.

In addition, DE 100 14 758 A1 discloses the simultaneous construction of the top boiler walls and internal components in the nearly finished boiler steel structure when constructing a steam generator. The top boiler walls are inserted by a crane from above through the still-open boiler top main grid into the boiler steel structure. During this process, the inner part of the boiler top main grid can be assembled on the boiler base and gradually hoisted, and then the internal components can be assembled. These are hoisted through the finished top part of the boiler wall by cable hoisting systems, and then the inner part of the boiler top main grid is connected to the outer part.

This system substantially accelerates the construction speed and hence shortens the construction time. However, the outer parts of the boiler top main grid are shifted far outside in order to lift the tube walls from above. Tie rods that are used to suspend the tube walls from the main beams of the boiler top main grid then sit on the brackets of the main beams. The resulting extra steel is 200 to 350 tons depending on the size of the boiler.

SUMMARY OF THE INVENTION

It is the task of the invention to present a method to construct a steam generator very quickly with less effort and materials.

In the method according to the invention, buckstay and tube wall modules are constructed and hoisted into the boiler steel structure while the boiler steel structure is being built. A buckstay and tube wall module is a unit consisting of buckstays and tube wall elements. This unit is placed in the boiler steel structure rather precisely at the place at which it will be finally mounted. The concept of inserting the buckstay and tube wall module in the boiler steel structure while constructing it makes work much easier since the parts belonging to the boiler wall do not have to be lifted each time through the top opening of a finished boiler steel structure. The boiler steel structure can reach between 100 and 180 m. It is sufficient to hoist the buckstay and tube wall module above the outer height of the boiler steel structure under construction, i.e. the parts do not have to be lifted and lowered as far as when installing them through the boiler top main grid. Another substantial advantage resulting from the method according to the invention arises from the arrangement of the main beams in the boiler top main grid. These are only placed on the boiler steel structure after all buckstay and tube wall modules are lifted into the boiler steel structure and temporarily placed on the provided place. The main beams can be placed vertically above the tube walls. The tube walls are preferably positioned in the middle of the beam or, conversely, the beams are positioned in the middle of the tube wall. The brackets for suspending tube wall anchors, etc. can be dispensed with. This has the advantage that the main beams of the outer boiler top main grid can be used to fix the beams of the inner boiler top main grid so that it does not need any of its own main beams. The beams of the inner boiler top main grid can accordingly be affixed directly to the main beams of the outer boiler top main grid after being raised through the finished gas pass. 200 to 350 tons are saved in comparison to solutions in which the inner boiler top main grid has its own main beams.

A large crane is usually necessary to construct steam generators. The crane's downtime is minimized by the presented assembly method. The buckstay and tube wall modules are hoisted from below by the large crane into the boiler steel structure while the boiler steel structure is being constructed. For this reason, the large crane becomes superfluous as soon as the main beams of the boiler top main grid are placed on the boiler steel structure. This results in enormous savings.

The vertical tubes are assembled by the method according to the invention on the ground and no longer high in the air in the boiler steel structure. The individual parts of the tube wall are joined with prefabricated components into buckstay and tube wall modules. By assembling them on the ground, weather becomes much less a factor, and construction is less susceptible to external and especially weather-related disturbances.

Finally, the construction time is reduced for assembling the vertical tubes of the boiler, and this can also reduce expenses.

In an initial embodiment, the entire boiler steel structure consists of steel beams and steel columns (pylons). In another advantageous embodiment, at least the vertical columns (pylons) are made of concrete. The pylons can for example be constructed in a sliding mold method. For example, concrete pylons can be created up to 90 m high after which initial girders and steel bracings can be incorporated. In principle, the buckstay and tube wall modules can be hoisted into the rising boiler steel structure even at this point, as is the case in pure steel construction. However, it is advantageous to first finish the boiler steel structure up to the top level with columns or pylons using the sliding mold method, and then insert in the buckstay and tube wall modules from above into the boiler steel structure with a large crane; then the main beams of the boiler top main grid can be placed on the boiler steel structure. At this point, the large crane becomes superfluous, and internal components finished just above the boiler base can be lifted with cable hoisting systems.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
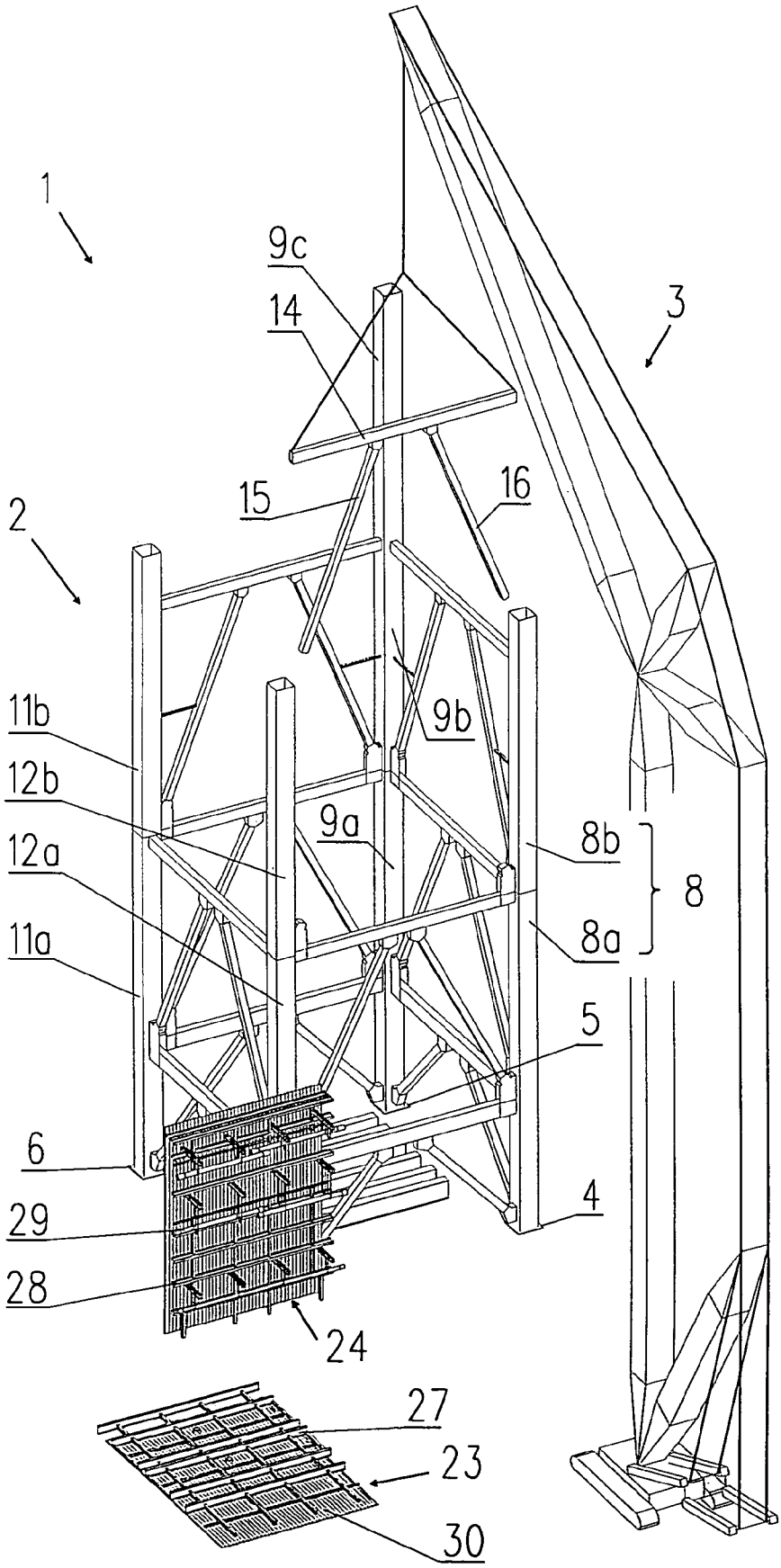
FIGS. 1 to 5 are perspective, schematic representations of initial building phases in accordance with the invention in constructing a steam generator from the building of the boiler steel structure to constructing the boiler walls.

FIG. 1 illustrates a steam generator 1 under construction to which a boiler steel structure 2 belongs. The boiler steel structure is erected on foundations 4, 5, 6, 7 by means of a crane 3. Standing on the foundations are columns 8, 9, 11, 12 made of steel that are formed by stacked units 8*a*, 8*b*, 9*a*, 9*b*, etc. The columns 8 to 12 are connected with each other by horizontal girders. FIG. 1 illustrates the hoisting of a girder 14 by a crane 3. Affixed to the girder 14 are bracings 15, 16 that prevent the boiler steel structure 2 from twisting.

In a first exemplary embodiment, the entire boiler steel structure 2 consists of steel. Both the columns 8, 9, 11, 12 and the girders 14 and bracings 15, 16 consist of corresponding steel profiles. However, it is possible to erect the boiler steel structure 2 in a mixed construction in which the columns 8, 9, 11, 12 consist of concrete, and the girders 14 as well as the bracings 15, 16 consist of steel. The columns 8, 9, 11, 12 can be constructed in a concrete sliding mold method as pylons or towers containing stairwells. The girders 14 are connected by tie rods that extend through the walls of pylons.

While construction is beginning on the boiler steel structure 2 or after the start of construction, parallel, spaced beams 17, 18, 19, 20, 21, 22 are arranged or erected on the boiler base, i.e., on the ground between the foundations 4, 5, 6, 7. Said beams form a part of the boiler top main grid to be finished later. The beams 17 to 22 are not connected with each other. They therefore do not form a solid grid, at least not in this stage of construction.

At a another place, preferably next to the boiler steel structure 2 under construction, buckstay and tube wall modules 23, 24, 25, 26 (see FIG. 2) are constructed lying or standing (at the latest when in the boiler steel structure has reached a certain height) that each represent a part of the boiler wall to be erected. As shown in FIG. 1, buckstays 27, 28 belonging to each buckstay and tube wall module are formed by horizontal crossbeams that are connected to each other by struts. In addition, prefabricated headers 29 are also simultaneously preassembled. Also belonging to the buckstay and tube wall modules 23, 24 are several tube wall elements that are connected to the buckstays 27, 28 and, with the exception of a few assembly joints, solidly cover the area of the boiler wall assumed by the respective buckstay and tube wall module 23, 24. They form a tube wall 30. Intermediate bearings or beams (not shown) are provided on the buckstay and tube wall modules 23, 24, 25, 26 that are preferably disposed on the vertical edges when in an upright state (module 24).

Figure 2:
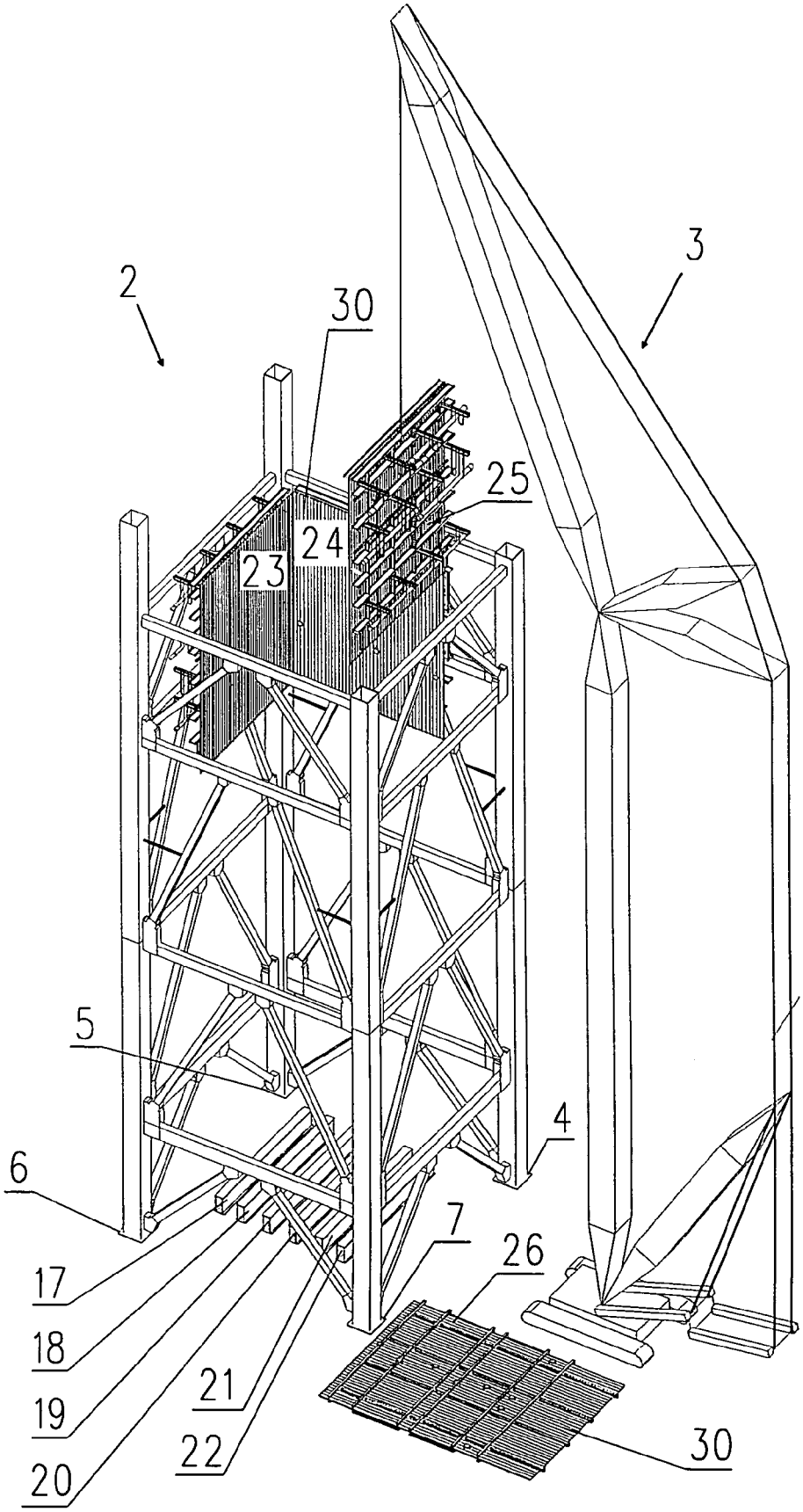

The steam generator 1 is then erected as the stage of construction in FIG. 1 continues where the available buckstay and tube wall modules 23-26 are inserted from above by means of a crane 3 into the partially erected boiler steel structure 2 according to FIG. 2. As can be seen, each buckstay and tube wall module 23-26 extends the entire width of the gas pass so that the four buckstay and tube wall modules (front, back and side walls) 23-26 form a complete, ring-shaped section in the boiler wall. The buckstay and tube wall modules 23-26 are then placed on the neighboring girders with their bearings (not shown) horizontally extending from the vertical edges, and fixed in the correct position in this state. As also illustrated by FIG. 2, the buckstay and tube wall modules only have to be lifted with the crane over the neighboring girders, and the boiler base always remains free. The base is available for the above-mentioned construction of the beams 17 to 22. Alternately, the buckstay and tube wall modules can also be assembled on the boiler base and set in an upright position if necessary (standing assembly is also possible) and placed on their installation site with the crane.

Figure 3:
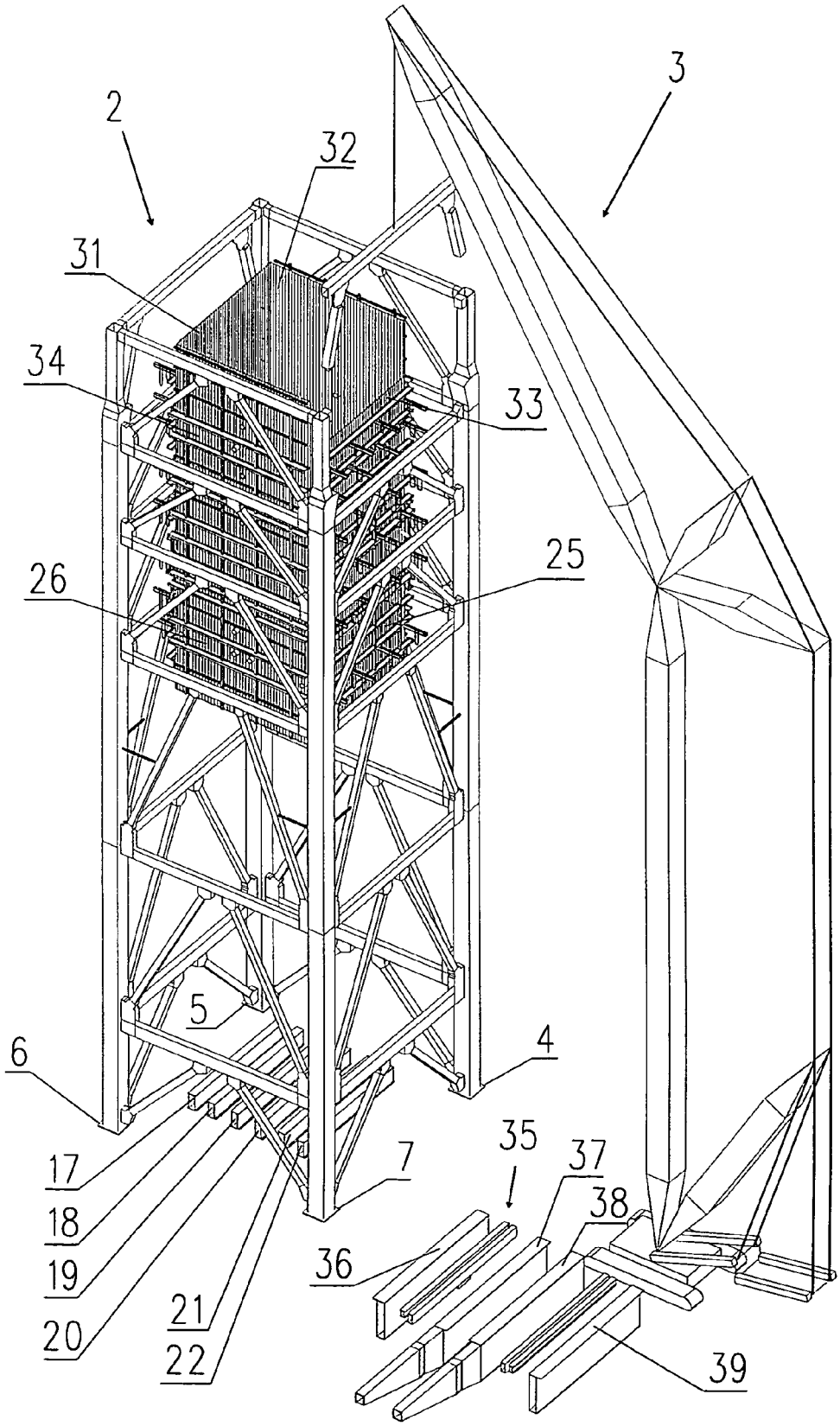

FIG. 3 illustrates a further stage of construction in which additional progress has been made as described in reference to FIGS. 1 and 2. After installing the buckstay and tube wall modules 23 to 26, another four buckstay and tube wall modules 31, 32, 33, 34 are erected and inserted into the additionally constructed boiler steel structure 2 with the crane 3. The buckstay and tube wall modules 31-34 are then easily affixed to the girders by means of beams.

Figure 4:
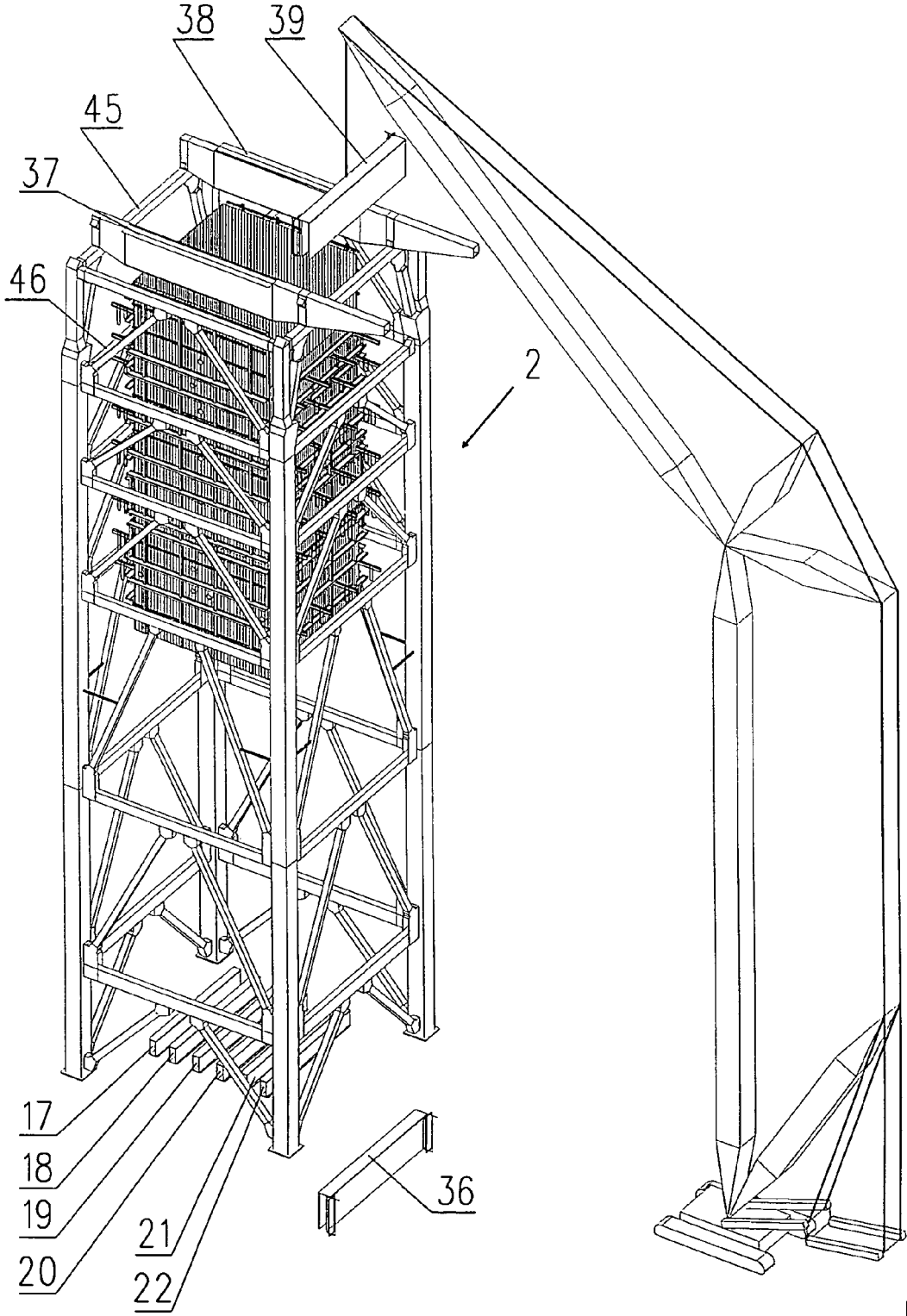
Figure 6:
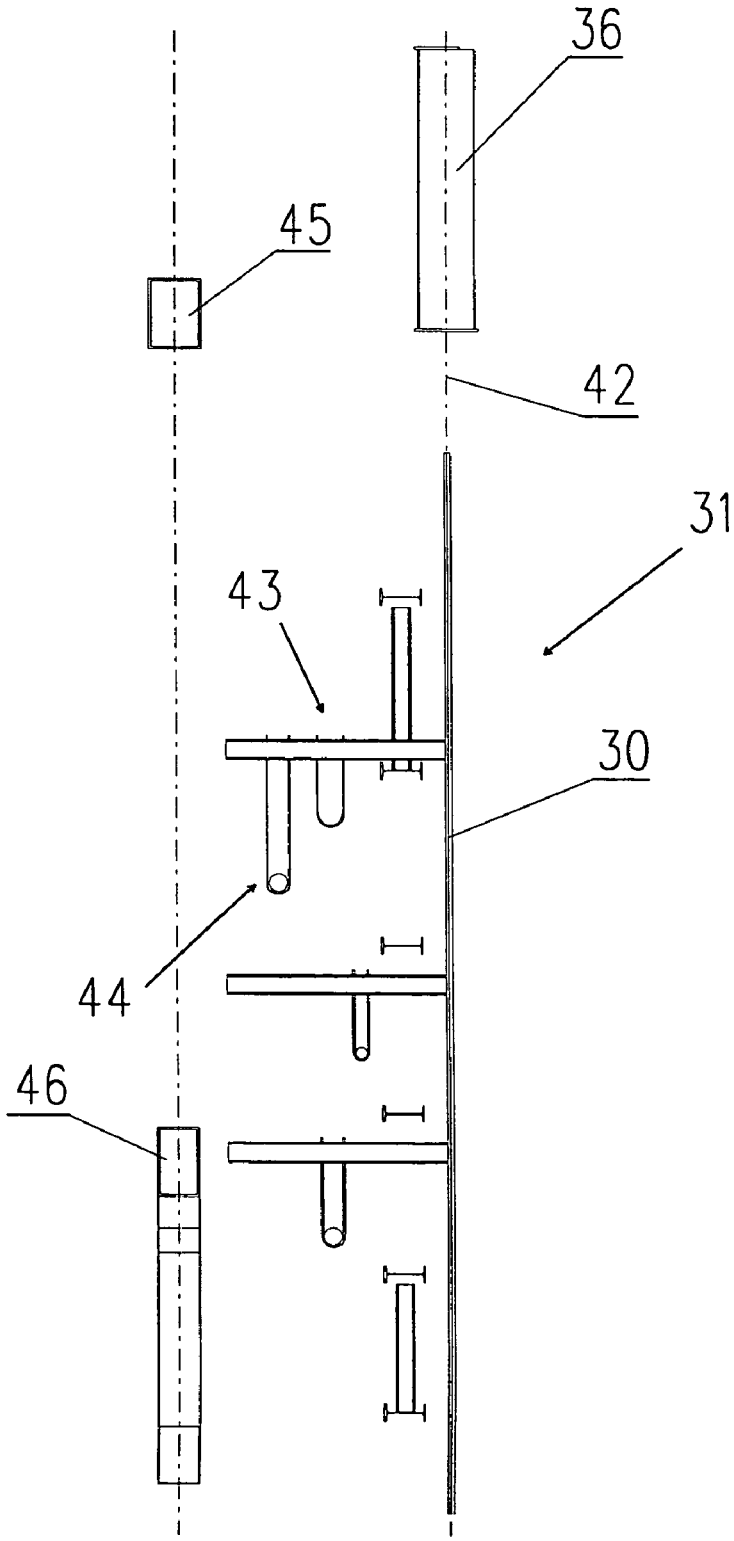
FIG. 6 is a lengthwise schematic section of the boiler steel structure and the boiler wall.

While constructing the boiler steel structure 2 and preliminarily installing the buckstay and tube wall modules 23-26 and 31-34, assembly of the main beams 36, 37, 38, 39 can start at another construction site 35, especially near the boiler steel structure 2, and the boiler top main grid 41 partially visible in FIG. 4 is formed from said main beams. When the main beams 36-39 are finished and the boiler steel structure 2 is ready with the installation of the last girder, the main beams 36-39 are placed above the boiler walls on the boiler steel structure 2 as illustrated in FIG. 4. They are arranged in a rectangle, whereby the main beams 36, 37, 38, 39 are horizontal and positioned vertically flush above the boiler walls underneath them. This is illustrated in particular by FIG. 6 with reference to main beams 36. The tube wall of the buckstay and tube wall module 31 assigned to said main beam is centrally disposed below the beam 36. Tie rods for connecting are indicated by a dash-dot line 42. FIG. 6 also illustrates brackets 43 and headers 44 affixed to the tube wall that are among the prefabricated components. In addition, FIG. 6 illustrates the spacing of the main beam 36 from the next neighboring girder 45 and girder underneath 46.

Figure 5:
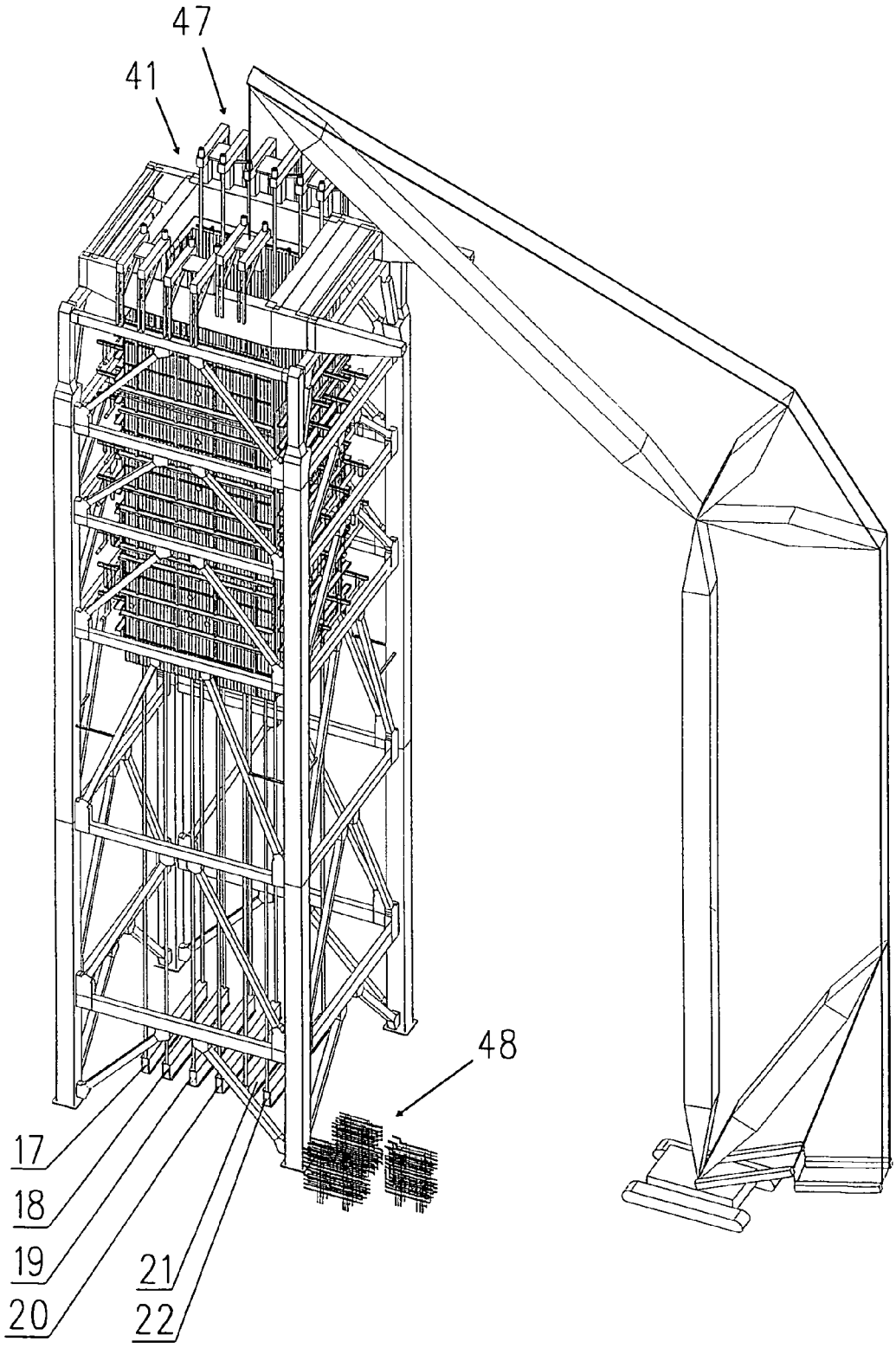

As illustrated in FIG. 5, the cable hoisting systems 47 are mounted on the main beams 36-39 after construction of the outer boiler top main grid 41 that is formed by the main beams 36-39. The cable hoisting systems 47 are hydraulic hoisting systems that are also termed hydraulic presses. Each of the beams 17-22 lying on the boiler floor is assigned two cables and two associated cable hoisting systems. The amount of work can now be doubled. On the one hand, the top gas pass can be finished by welding together the buckstay and tube wall modules 23-26 and 31-34. The vertically stacked vertical tubes with abutting faces of the tube wall modules are joined by weld seams. The vertical joints are also closed by welding. During this process, the cable hoisting systems 47 lift the beams 17-22 until the internal components 48 are placed underneath them and affixed suspended from them. The beginning of this process is illustrated in FIG. 5. Convection heating surfaces such as superheaters, reheaters, economizers, etc. are among the internal components 48. They are formed by the tube bundles that are affixed to beams 17-22 by means of corresponding suspension devices.

Figure 7:
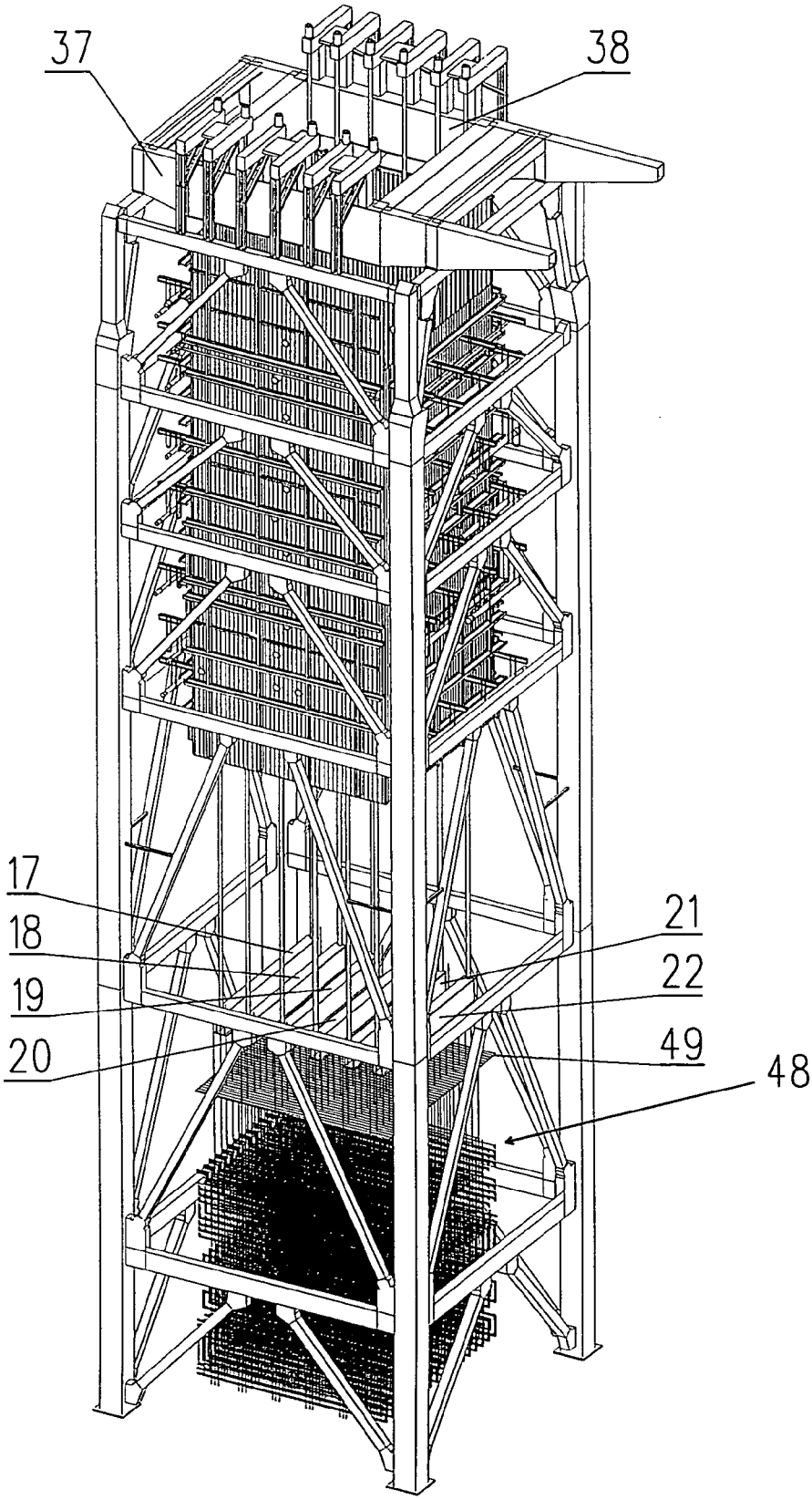
FIGS. 7 to 9 are perspective, schematic representations of subsequent building phases in accordance with the invention, while building and hoisting internal components.
Figure 8:
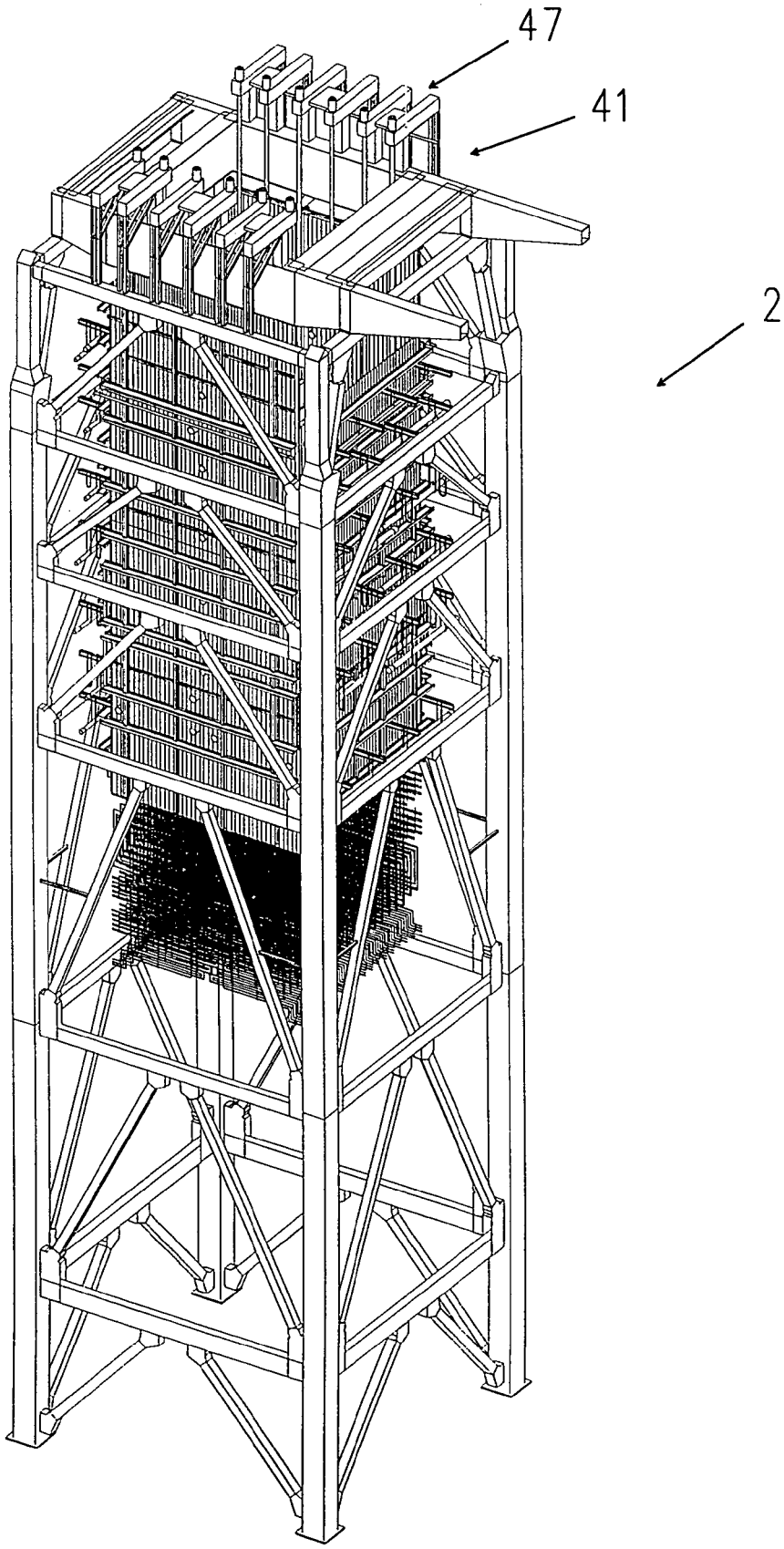

FIG. 7 illustrates the preassembly of the interior components 48 at an advanced stage. Suspended directly below the beams 17-22 that are now relatively high is a tube wall 49 that will form the top end of the gas pass. Suspended below this essentially horizontal tube wall are the internal components 48 that are now completed. By actuating the cable hoisting systems 47, these are hoisted into the gas pass as in FIG. 8.

Figure 9:
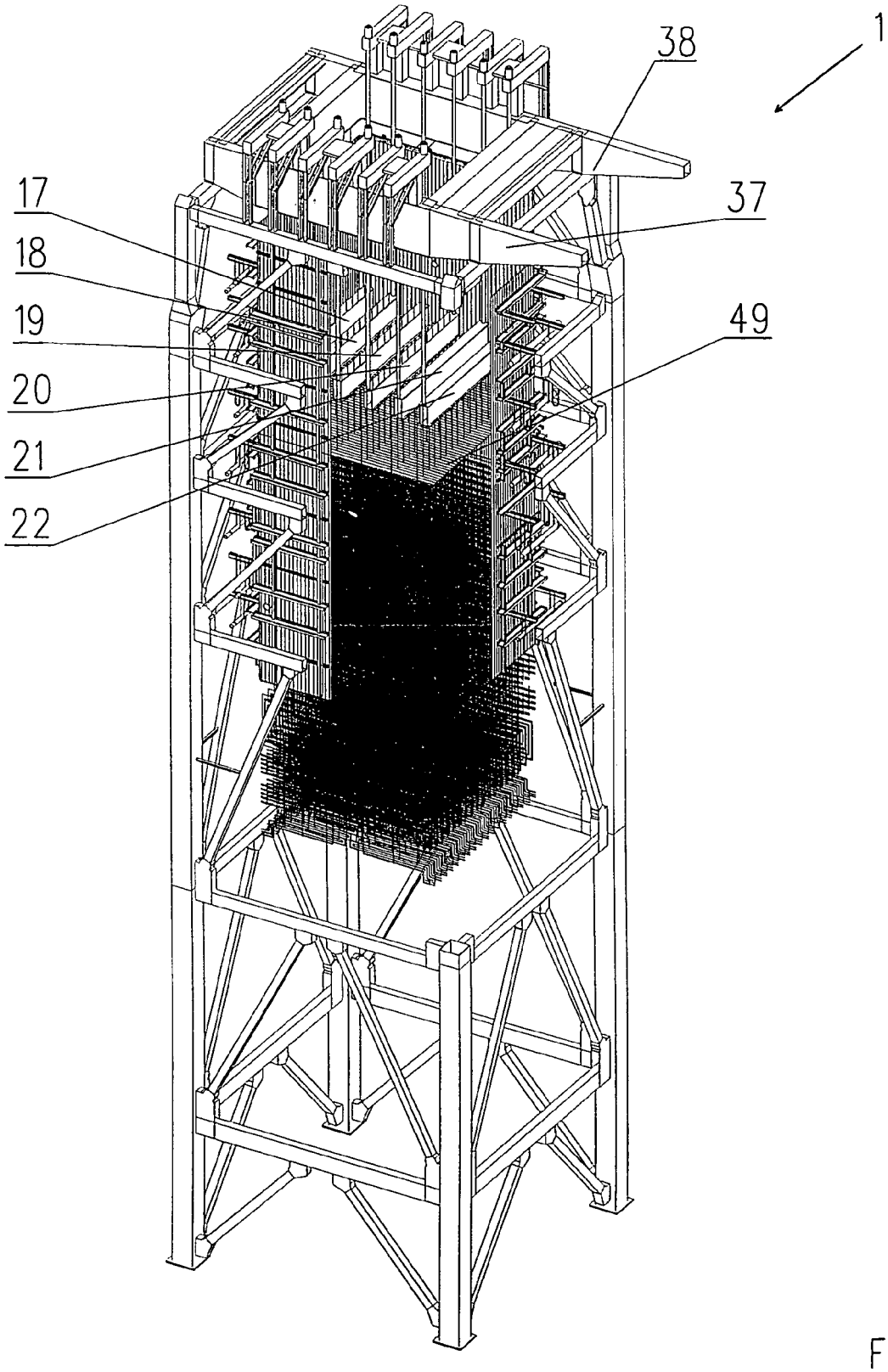

FIG. 9 illustrates a partial section of the steam generator 1 under construction. This shows in particular how beams 17-22 are simultaneously lifted through the gas pass. They are hoisted to the height of the boiler top main grid 41 and then joined to the main beams 37, 38. Since the tie rods that bear the boiler walls run through the gaps of the main beams 37, 38, they have smooth surfaces on the flat sides facing each other to which the beams 17-22 can be affixed. Once this is done, the tube wall 49 is connected to the boiler walls whereupon the top part of the gas pass is completely assembled. The bottom part of the gas pass can now be finished by placing vertical or preferably angled tube walls from below onto the suspended boiler walls and connecting them to the boiler walls.

When a steam generator 1 is being constructed, buckstay modules are connected with tube wall units to form buckstay and tube wall modules temporarily disposed in the boiler steel structure level by level while constructing the boiler steel structure 2. Then the outer part of the boiler top main grid is erected whose beams are flush with the tube walls of the buckstay and tube wall modules. The boiler wall is then assembled by aligning and welding the individual tube wall modules from top to bottom. Simultaneously, the internal components are erected on the boiler base and hoisted to the installation height.

The preliminary assembly of the buckstay and tube wall modules eliminates the necessity of inserting buckstays or tube walls from above through the boiler top main grid. For this reason, the boiler top main grid opening can be smaller than usual. The inner boiler top main grid therefore does not require its own main beam, which saves a substantial amount of steel.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method to construct a steam generator including at least a boiler steel structure, a boiler top main grid having a plurality of main beams, and a gas pass defined by tube walls surrounded by buckstays, the gas pass having a width and the steam generator containing internal components, the method comprising the following steps:

a) constructing a plurality of foundations around a boiler base;

b) commencing construction of the boiler steel structure on the foundations;

c) constructing the buckstay and tube wall modules by joining buckstay modules and tube wall units;

d) hoisting the buckstay and tube wall modules into the boiler steel structure under construction, and temporarily placing the buckstay and tube wall modules into an installation position;

e) arranging a plurality of lifting beams on the boiler base;

f) arranging the main beams of the boiler top main grid on the boiler steel structure;

g) aligning and assembling the tube walls;

h) hoisting the lifting beams in steps with a plurality of cable hoisting systems, and suspending the internal components under the lifting beams;

i) hoisting the internal components to an installation height at which the lifting beams are at an assembly height with the main beams; and j) joining the lifting beams with the main beams and connecting the internal components.

2. The method of claim 1 wherein the buckstay and tube wall modules are constructed lying or standing next to the boiler steel structure.

3. The method of claim 1 wherein the buckstay and tube wall modules extend across the width of the gas pass.

4. The method of claim 1 wherein the buckstay and tube wall modules have oppositely disposed vertical edges and include at least one holder extending from a one of the vertical edges, the at least one holder supporting the buckstay and tube wall module on a horizontal girder of the boiler steel structure.

5. The method of claim 1 wherein the main beams in step f are vertically flush with the tube walls.

6. The method of claim 1 wherein the main beams form a rectangular frame viewed from the top that surrounds an opening which is smaller than the inside width of the gas pass.

7. The method of claim 1 wherein the lifting beams in step e are spaced adjacent to each other without being connected and are connected by cables of the cable hoisting systems.

8. The method of claim 1 wherein step g and step h are done at the same time.

9. The method of claim 1 wherein the boiler steel structure includes columns made of concrete using a sliding mold method.

* * * * *